United States Patent [19]

Tokunaga et al.

[11] 4,180,970

[45] Jan. 1, 1980

[54] WRISTWATCH WITH SOUND-MAKING DEVICE

[75] Inventors: Ikuo Tokunaga; Hideaki Uchiyama; Yoshiaki Fujimori, all of Suwa, Japan

[73] Assignee: Kabushiki Kaisha Suwa Seikosha, Tokyo, Japan

[21] Appl. No.: 813,398

[22] Filed: Jul. 6, 1977

[30] Foreign Application Priority Data

Jul. 6, 1976 [JP] Japan ..... 51/89478

[51] Int. Cl.[2] ..... G04B 23/12; G04B 37/08; G04C 21/34; G04B 39/00

[52] U.S. Cl. ..... 58/57.5; 58/88 R; 58/90 R; 58/91

[58] Field of Search ..... 58/38 A, 38 R, 53-55, 58/57.5, 88 R, 90, 91, 19 A, 39, 90 R, 152 B

[56] References Cited

U.S. PATENT DOCUMENTS

| | | | |
|---|---|---|---|
| 3,462,943 | 8/1969 | Spandi | 58/57.5 |
| 3,577,876 | 5/1971 | Spandi | 58/57.5 |
| 3,638,418 | 2/1972 | Spandi | 58/57.5 |

*Primary Examiner*—Edith S. Jackmon

*Attorney, Agent, or Firm*—Blum, Kaplan, Friedman, Silberman & Beran

[57] ABSTRACT

A wristwatch having a sound-emitting device or alarm therein includes a watch case, a cover glass and a case back. The sound-emitting device is mounted in the watch case from the back side in a mounting opening formed in the watch case. The watch case is formed with a sound-emitting aperture on the top surface over at least a portion of the mounting opening of smaller size than the mounting opening.

10 Claims, 2 Drawing Figures

WRISTWATCH WITH SOUND-MAKING DEVICE

BACKGROUND OF THE INVENTION

The invention relates generally to a wristwatch having a sound-emitting device therein, and particularly to a wristwatch containing an alarm buzzer wherein the sound is emitted from the top surface of the watch case.

In conventional alarm wristwatches the alarm sound is emitted from the back side of the wristwatch. In such constructions, the sound emitting from the watch case is obstructed by a wearer's wrist when the wristwatch is worn by a wearer. When a sound-emitting aperture is positioned in the side of a conventional watch case, the watch becomes thick, resulting in undesirable wristwatch design.

SUMMARY OF THE INVENTION

Generally speaking, in accordance with the invention, a wristwatch having a sound-emitting device therein is provided which overcomes the disadvantages of conventional sound-emitting wristwatches. A wristwatch constructed in accordance with the invention includes a sound-emitting device mounted in a mounting aperture formed in the watch case. The sound-emitting device is mounted in the watch case from the back side. A sound-emitting aperture of smaller size than the mounting aperture is formed on the top surface of the watch case for communicating between the mounting aperture and the top surface of the watch case. This permits the sound to be emitted from the watch case without interruption by a wearer's wrist.

Accordingly, it is an object of this invention to provide an improved wristwatch having a sound-emitting device therein.

Another object of the invention is to provide a wristwatch having a sound-emitting device therein with improved sound-emitting properties.

A further object of the invention is to provide a wristwatch having a sound-emitting device therein for improved design.

Still another object of the invention is to provide an improved sound-emitting device therein which is water-proof.

Still other objects and advantages of the invention will in part be obvious and will in part be apparent from the specification and drawings.

The invention accordingly comprises the features of construction, combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the above accompanying drawings, in which.

DESCRIPTION OF THE PREFERRED EMBODIMENTS

Figure 1:
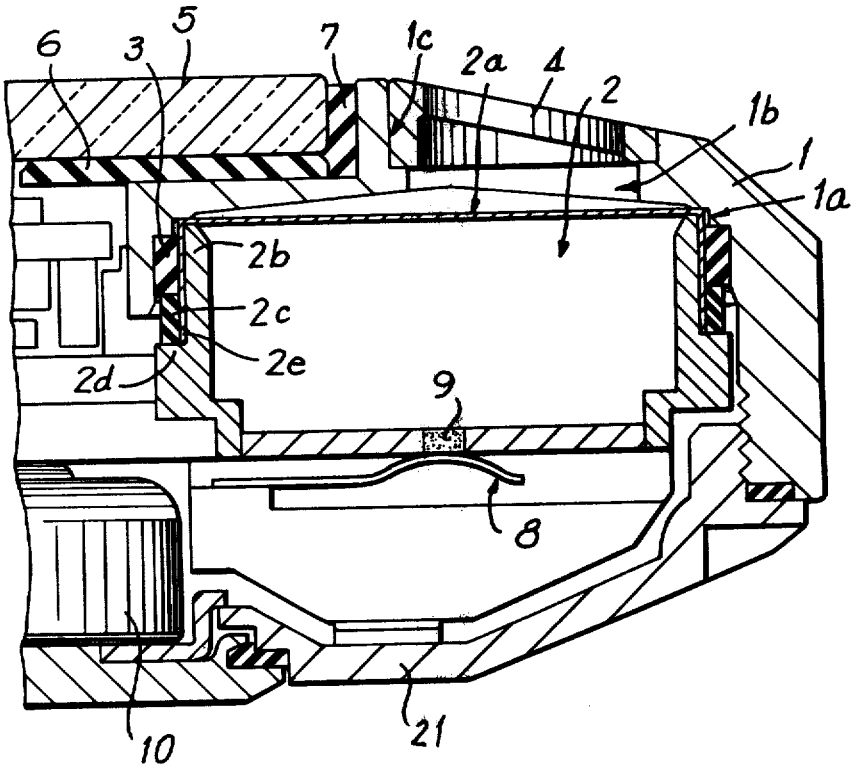
FIG. 1 is a partial cross-sectional view of a wristwatch having a sound-emitting device therein constructed in accordance with the instant invention.

Referring now to FIG. 1, the sound-emitting portion of a wristwatch constructed and arranged in accordance with the instant invention is shown. A watch case 1 is formed with a mounting aperture 1*a* for receiving therein a sound-emitting device, such as alarm 2 which is mounted in watch case 1 from the back side. Watch case 1 is formed with a sound-emitting aperture 1*b* of smaller size than mounting aperture 1*a* and positioned on the top surface of the wristwatch directly above at least a portion of mounting aperture 1*a*. The wristwatch is constructed in this manner to permit sound emanating from alarm 2 to be released from the top surface of the watch case.

A cover glass 5 is mounted releasably in an opening formed in watch case 1 for viewing inside watch case 1. A glass packing 7 of a resilient material is positioned between cover glass 5 and watch case 1 and is compressed in the radial direction to secure placement of cover glass 5. A mask 6 for covering a portion of the inside of watch case 1 is positioned beneath cover glass 1 abutting glass packing 7. A watch case back 21 is mounted releasably in watch case 1. A sound-emitting aperture cover 4 is mounted above sound-emitting aperture 1*b* and secured in an opening 1*c* in watch case 1 by an adhesive or other means. Sound-emitting aperture cover 4 may be formed with holes or slits for releasing sound.

Alarm 2 is formed with a substantially cylindrical side wall 2*b* having an outwardly extending flange 2*d* on the lower surface of side wall 2*b*. A diaphram 2*a* forms the top surface of alarm 2. Diaphram 2*a* is formed with a peripheral lip 2*e* which extends around side wall 2*b* and abuts the top surface of flange 2*d*. Alarm 2 is formed with contacts 9 (only one of which is shown) which abuts terminals 8 (only one of which is shown) for providing electric current to alarm 2 from a battery 10. A diaphram fixing ring 2*c* is positioned around diaphram side wall 2*b* abutting flange 2*d* and secures diaphram 2*a* against side wall 2*b*. Alarm 2 is mounted in mounting aperture 1*a* in watch case 1 from the back side. A waterproofing gasket 3 is positioned around diaphram lip 2*e* and is compressed between diaphram fixing ring 2*c* and watch case 1 to provide a water-tight seal between diaphram 2*a* and the interior of watch case 1.

Figure 2:
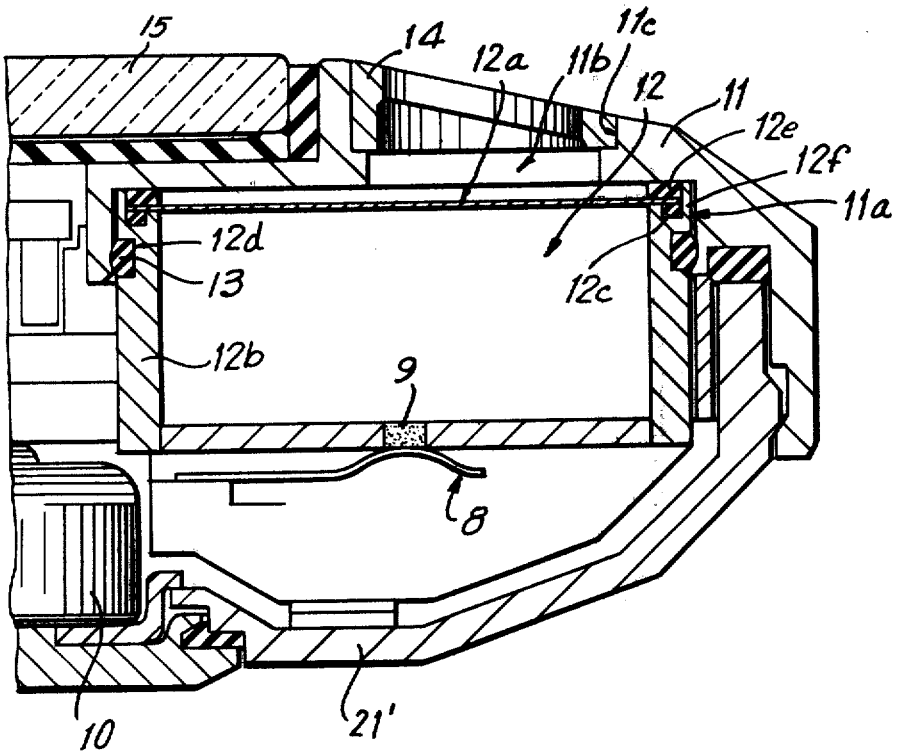
FIG. 2 is a partial cross-sectional view of a wristwatch having a sound-emitting device therein constructed in accordance with another embodiment of the invention.

Referring now to FIG. 2, a second embodiment of a sound-emitting portion of a wristwatch having a sound-emitting device therein constructed and arranged in accordance with the invention is shown. A watch case 11 is formed with a mounting aperture 11*a* for receiving therein an alarm 12. Watch case 11 is formed further with a sound-emitting aperture 11*b* of smaller size than mounting aperture 11*a* located on the top surface of watch case 11 directly above at least a portion of mounting aperture 11*a*. A sound-emitting aperture cover 14 is provided to cover sound-emitting aperture 11*b* and is mounted in a sound-emitting aperture cover opening 11*c* formed in the top of watch case 1. Aperture cover 14 is formed with holes or slits to permit sound emanating from alarm 12 to leave the top of the wristwatch case without interruption.

Alarm 12 is formed with a substantially cylindrical side wall 12*b*, a bottom wall having an electrical contact 15 (only one of which is shown) and a diaphram 12*a* which is the top surface for emitting sound. Side wall 12*b* is formed with a peripheral upwardly extending lip 12*f* and a groove 12*d* along the inside top surface for placing therein a packing ring 13 of a resilient material. Diaphram 12*a* is mounted across the top of side wall 12*b* over packing ring 12*c* for water-proofing, and a fixing ring 12*e* of a resilient material is placed over the periphery of diaphram 12*a*. When alarm 12 is mounted in watch case 11 from the back side, water-proofing gasket 12*c* is compressed between side wall 12*b* of alarm 12 and diaphram 12*a* to insure a water-tight seal between the top surface of diaphram 12*a* and the internal portion of alarm 12. Side wall 12*b* is formed further with a gasket mounting groove 12*d* therearound to receive a mounting gasket 13 for providing a water-tight seal between the sound-emitting aperture 11*b* and the interior of watch case 11 on the other side of gasket 13. Gasket 13 is compressed in the radial direction against the inside surface of case body 11 at mounting aperture 11*a*. A watch case back 21' is releasably mounted in watch case 11, removal of said back permitting access to said alarm for service.

Accordingly, by constructing and arranging the wristwatch and sound-emitting device in the manner described a sound may leave the watch case uninterrupted by a wearer's wrist. Water-proofing gaskets are used selectively to secure a diaphram to the top surface of the sound-emitting device and in turn provide a water-tight seal between the top surface of the diaphram and the interior of the sound-emitting device and the wristwatch.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a water resistant wristwatch case for supporting a sound-emitting device therein, the improvement comprising a watch case having a front exterior surface and a interior including a first sound-emitting aperture formed in said exterior surface of said case, and at least one cavity formed in the interior of said case, at least part of said cavity being disposed in overlapping relationship with said sound-emitting aperture in plan view, to define an acoustic connection therebetween, and a sound-emitting device positioned in said cavity, a gasket means disposed in said cavity and surrounding said sound-emitting device for water-sealing the interior of said wristwatch case, and a cover glass releasably mounted in the front exterior surface of said wristwatch case, said cover glass overlapping at least a portion of said cavity in plan view.

2. A water resistant wristwatch case as claimed in claim 1, wherein said sound-emitting aperture is of smaller dimension than said cavity formed in the interior of said wristwatch case in plan view.

3. The wristwatch case of claim 1, wherein said sound-emitting device is formed with a substantially cylindrical side wall, a bottom wall and a diaphram mounted across the top surface of said device.

4. The wristwatch case of claim 3, wherein said sound-emitting device is formed with an outwardly extending flange on said side wall and said diaphram is formed with a downward extending peripheral lip to cover said side wall of said sound-emitting device to said flange and including a fixing ring means compressed against said diaphram lip to hold said diaphram against the side walls of said sound-emitting device.

5. The wristwatch case of claim 4, wherein said sound-emitting device is mounted in said opening cavity and said gasket means is engaged compressively between said fixing ring means and the top surface of said cavity to provide a water-tight seal to said sound-emitting aperture.

6. The wristwatch case of claim 5, including terminal means for providing an electrical connection to said sound-emitting device in the interior of said case when said sound-emitting device is disposed in said cavity.

7. The wristwatch case of claim 1, including a sound-emitting aperture cover mounted in said watch case means in said sound-emitting aperture.

8. The wristwatch case of claim 7, wherein said sound-emitting aperture cover is formed with holes.

9. The wristwatch case of claim 3, wherein said sound-emitting device is formed with a groove in the top of said side wall, a first fixing means mounted in said groove and a second fixing means mounted on top of said diaphram over said side wall to provide a water-tight seal to the interior of said sound-emitting device.

10. The wristwatch case, of claim 9, wherein said sound-emitting device is formed further with a groove therearound for receiving said gasket means to provide a water-tight seal between said sound-emitting aperture and the interior of said watch case.

* * * * *